United States Patent [19]

Babyak

[11] Patent Number: 5,031,508

[45] Date of Patent: Jul. 16, 1991

[54] RIVET SETTING TOOL

[75] Inventor: Richard J. Babyak, Trumbull, Conn.

[73] Assignee: Emhart Inc., Newark, Del.

[21] Appl. No.: 577,955

[22] Filed: Sep. 5, 1990

[51] Int. Cl.[5] ..... F15B 11/08; F15B 13/04

[52] U.S. Cl. ..... 91/440; 92/82; 29/243.525; 181/230

[58] Field of Search ..... 91/399, 400, 437, 438, 91/440, 461; 60/369, 370, 407; 92/82; 72/453.19, 391, 453.17; 29/243.525; 181/229, 230

[56] References Cited

U.S. PATENT DOCUMENTS

| | | | |
|---|---|---|---|
| 3,410,180 | 11/1968 | Spangler et al. | 91/440 |
| 3,456,561 | 7/1969 | Laikam, Jr. | 91/440 |
| 3,815,475 | 6/1974 | Howard et al. | 91/399 |
| 3,853,037 | 12/1974 | Denzler et al. | 91/440 |
| 4,303,131 | 12/1981 | Clark | 181/230 |
| 4,609,069 | 9/1986 | Konagai | 181/230 |
| 4,648,258 | 3/1987 | Frearson | 29/243.525 |
| 4,773,222 | 9/1988 | Tanaka et al. | 91/461 |

*Primary Examiner*—Edward K. Look
*Assistant Examiner*—Thomas Denion
*Attorney, Agent, or Firm*—Spencer T. Smith

[57] ABSTRACT

A pneumatically operated hydraulically intensified rivet setting tool exhausts into the intensifier sleeve above the piston where the air expands and exits between the sleeve and the housing through a ring plenum and out an exit conduit.

2 Claims, 1 Drawing Sheet

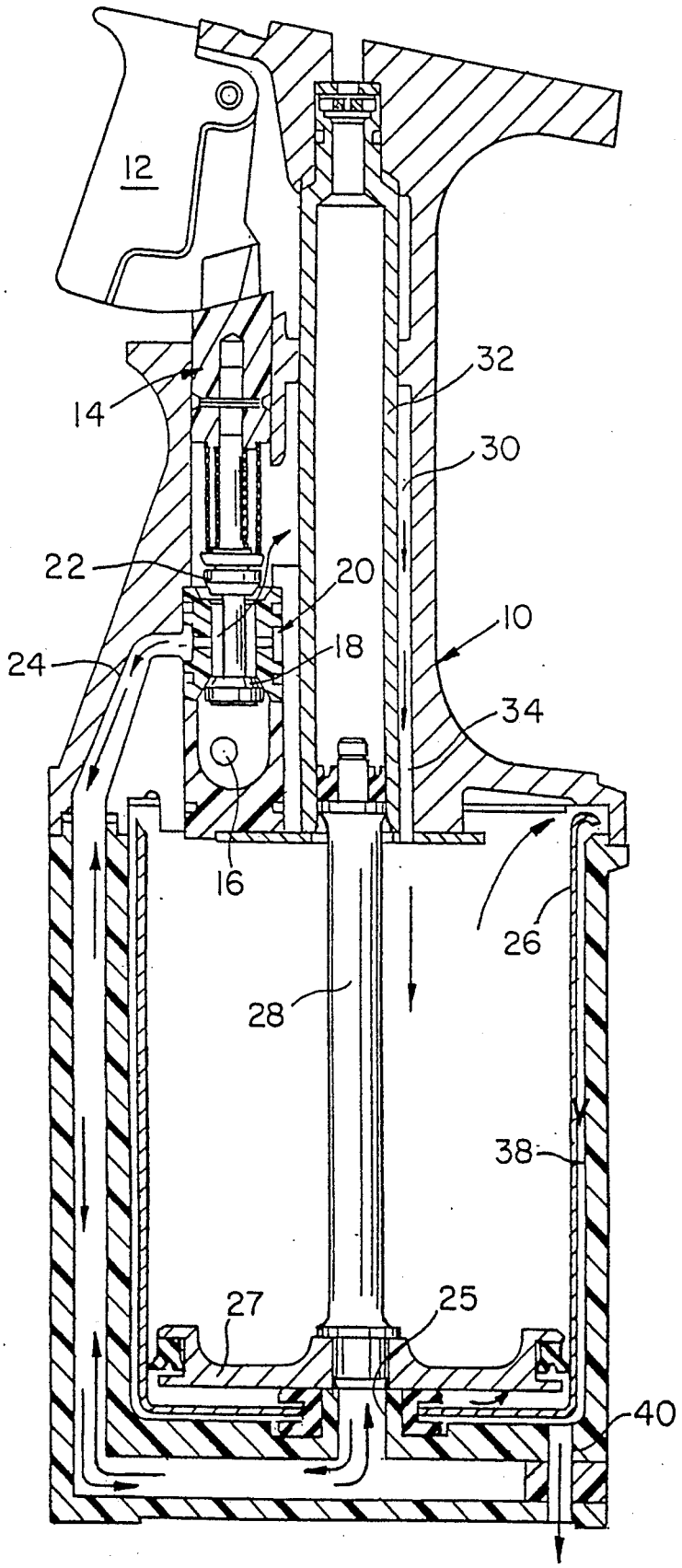
12
14
32
30
22
20
10
24
18
34
16
26
28
38
27
25
40

RIVET SETTING TOOL

The present invention relates to air operated rivet setting tools which hydraulically intensify line air pressure to the rivet and which following rivet setting exhaust this air.

It is always desirable to reduce the amount of noise resulting from the operation of such a tool. Since exhaust air contributes to this noise it is an object of the present invention to reduce the noise levels of the exhausting air.

Other objects and advantages of the present invention will become apparent from the following portion of this specification and from the accompanying drawing which illustrates in accordance with the mandate of the patent statutes a presently preferred embodiment incorporating the principles of the invention.

REFERRING TO THE DRAWING

The sole FIGURE is an elevational cross sectional view of a portion of a rivet setting tool made in accordance with the teachings of the present invention.

The rivet setting tool 10 includes a trigger 12 which when displaced from the illustrated release position to the depressed position will displace a push rod assembly 14 from an upper position to a lower position. When the trigger is released supply air, at a selected pressure enters the tool via a conduit 16 and pushes the lower seal 18 of a two position poppet valve 20 into a sealing position blocking air flow to the tool.

When the trigger 12 is depressed, the push rod assembly 14 lowers the upper seal 22 of the poppet valve 20 into a sealing position blocking the exhaust of air from the tool. Pressurized air will accordingly be admitted through the poppet valve 20 into an intake conduit 24 which communicates via a suitable opening 25 in the intensifier sleeve 26 with the bottom of the piston 27 of a hydraulic intensifier. The piston moves upwardly forcing liquid contained above the rod 28 at much higher pressure into the ram (not shown) to operate the rivet tool. Arrows illustrate this movement of the pressurized air.

When the rivet has been set and the trigger has been released to reset the tool, the piston will be returned to its original illustrated position. Air which had filed a large portion of the intensifier sleeve 26 will now be forced back through the intake conduit 24 and will flow through the now open upper seal 22 of the poppet valve

20 (the lower seal 18 is now closed) into a chamber 30 which extends around the ram sleeve 32 and which communicates via a slot or channel 34 with the interior of the intensifier sleeve 26. This volume will accordingly function as an expansion chamber. The expanded air then passes between the intensifier sleeve 26 and the intensifier chamber 38 (this annular volume functioning as a ring plenum) exhausting from the tool via an outlet conduit 40.

With this design the noise level resulting from air exhausting is substantially decreased and desired cooling of the ram sleeve is achieved.

I claim:

1. A rivet setting tool comprising a hydraulic intensifier including an intensifier housing defining an interior chamber, an intensifier sleeve within said chamber, a handle secured on top of said intensifier housing including a ram sleeve, an intensifier assembly including a piston displaceable within said intensifier sleeve and a rod displaceable within said ram sleeve and first conduit means extending through said housing and communicating with said interior housing chamber, a cup shaped intensifier sleeve within said interior housing chamber, said intensifier sleeve spaced from said interior housing chamber to define air passage means from the interior of said intensifier sleeve above said piston to said first conduit means, means for exhausting air from said interior intensifier housing chamber including intake air conduit means in said handle and said housing communicating with the interior of said sleeve below said piston, exhaust air conduit means defined in said handle communicating with said intensifier sleeve above said piston, and valve means for blocking the communication between said intake and exhaust conduit means when a trigger is depressed and for interconnecting said conduits when said trigger is released.

2. A rivet setting tool according to claim 1 wherein said first conduit means extends through said housing proximate the bottom of said cup shaped intensifier sleeve.

* * * * *